US010133205B2

(12) United States Patent
Berry et al.

(10) Patent No.: US 10,133,205 B2
(45) Date of Patent: Nov. 20, 2018

(54) CIRCUIT FOR DRIVING A LIGHT SOURCE IN IMAGING DEVICE FOR ENHANCING QUALITY OF ISOLATED PIXELS

(71) Applicant: LEXMARK INTERNATIONAL, INC., Lexington, KY (US)

(72) Inventors: John Bruce Berry, Lexington, KY (US); William Pohl Corbett, Jr., Lexington, KY (US); Robert Michael Tulenko, Versailles, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 15/472,733

(22) Filed: Mar. 29, 2017

(65) Prior Publication Data

US 2018/0284638 A1 Oct. 4, 2018

(51) Int. Cl.
*G03G 15/00* (2006.01)
*G03G 15/043* (2006.01)
*G03G 15/04* (2006.01)

(52) U.S. Cl.
CPC ..... *G03G 15/043* (2013.01); *G03G 15/04072* (2013.01)

(58) Field of Classification Search
CPC ..... G03G 15/04036; G03G 15/04072; G03G 15/043; G09G 3/25; H04N 1/06
See application file for complete search history.

(56) References Cited

U.S. PATENT DOCUMENTS

| | | | | |
|---|---|---|---|---|
| 5,946,334 | A | 8/1999 | Ema | |
| 6,763,048 | B2 | 7/2004 | Govorkov | |
| 8,089,996 | B2 | 1/2012 | Updegraff | |
| 8,750,341 | B2 | 6/2014 | Bazzani | |
| 2008/0019407 | A1* | 1/2008 | Li | G01S 7/491 372/38.02 |
| 2009/0310636 | A1 | 12/2009 | Updegraff | |
| 2011/0228037 | A1 | 9/2011 | Omori | |
| 2014/0139603 | A1* | 5/2014 | Fujita | H01S 5/0427 347/118 |
| 2014/0139605 | A1 | 5/2014 | Fujita | |

* cited by examiner

*Primary Examiner* — Hoang Ngo

(57) ABSTRACT

An imaging device has a photoconductor with a surface that is selectively discharged by a light from a laser diode to create a latent electrostatic image for attracting toner for transfer to a media. A circuit drives the laser diode. The circuit has a switch for turning on and off the light, a resistor complementary to the laser diode selectively connectable to the switch, and a passive circuit component coupled to the laser diode. The passive circuit component is a delay line, inductor, choke, coiled wire, or ferrite bead is contemplated. It may also typify a length of copper tracing on a printed circuit board that supports the laser diode. The circuit causes an initial overshoot voltage spike in an on voltage pulse that is about 20% or more than the settled on voltage. The voltage spike dampens out in about one-fourth of a total voltage on time of the pulse.

20 Claims, 8 Drawing Sheets

CIRCUIT FOR DRIVING A LIGHT SOURCE IN IMAGING DEVICE FOR ENHANCING QUALITY OF ISOLATED PIXELS

FIELD OF THE INVENTION

The present disclosure relates to a circuit for driving a light source for selectively discharging a photoconductor in an imaging device for attracting toner for transfer to a media. It relates further to enhancing the imaging of pixels isolated from other pixels transferred to the media.

BACKGROUND

Photoconductors have long been used in the electrophotographic (EP) process. They have a surface that gets selectively discharged by a beam of light to create a latent electrostatic image for development with toner for transfer to media. A rotating mirror typically scans the beam of light in a path across the photoconductor and a switch turns on and off the light according to pixels of imaging data. When selectively discharging but a single pixel isolated from all other pixels on a same or adjacent scan paths, not enough charge exists on the photoconductor to adhere sufficient amounts of toner which can lead to image quality problems on the printed media. Augmenting power to the light helps improve charge per each pixel, but causes halftone pixels to darken, thereby causing other image quality problems on the printed media. A need exists to overcome these problems.

SUMMARY

An imaging device has a photoconductor with a surface that is selectively discharged by a light from a laser diode to create a latent electrostatic image for attracting toner for transfer to a media. A circuit drives the laser diode. The circuit has a switch for turning on and off the light according to image data. A resistor complements the laser diode and is selectively connectable to the switch in opposition to the switch's connection to the laser diode. The resistor has an impedance. The impedance ranges from approximate the impedance of the laser diode to much greater than the impedance of the laser diode. A passive circuit component (P) couples to the laser diode. The passive circuit component is a delay line, inductor, choke, coiled wire, or ferrite bead. The component may also typify a length of copper tracing on a printed circuit board that supports the laser diode. The circuit causes an initial overshoot voltage spike in an on voltage pulse that is about 20% or more than the on voltage in the circuit absent the passive circuit component. The voltage spike dampens out relatively quickly in a time approximately one-fourth of a total voltage on time of the pulse. These and other embodiments are described below.

DETAILED DESCRIPTION OF THE ILLUSTRATED EMBODIMENTS

Figure 1:
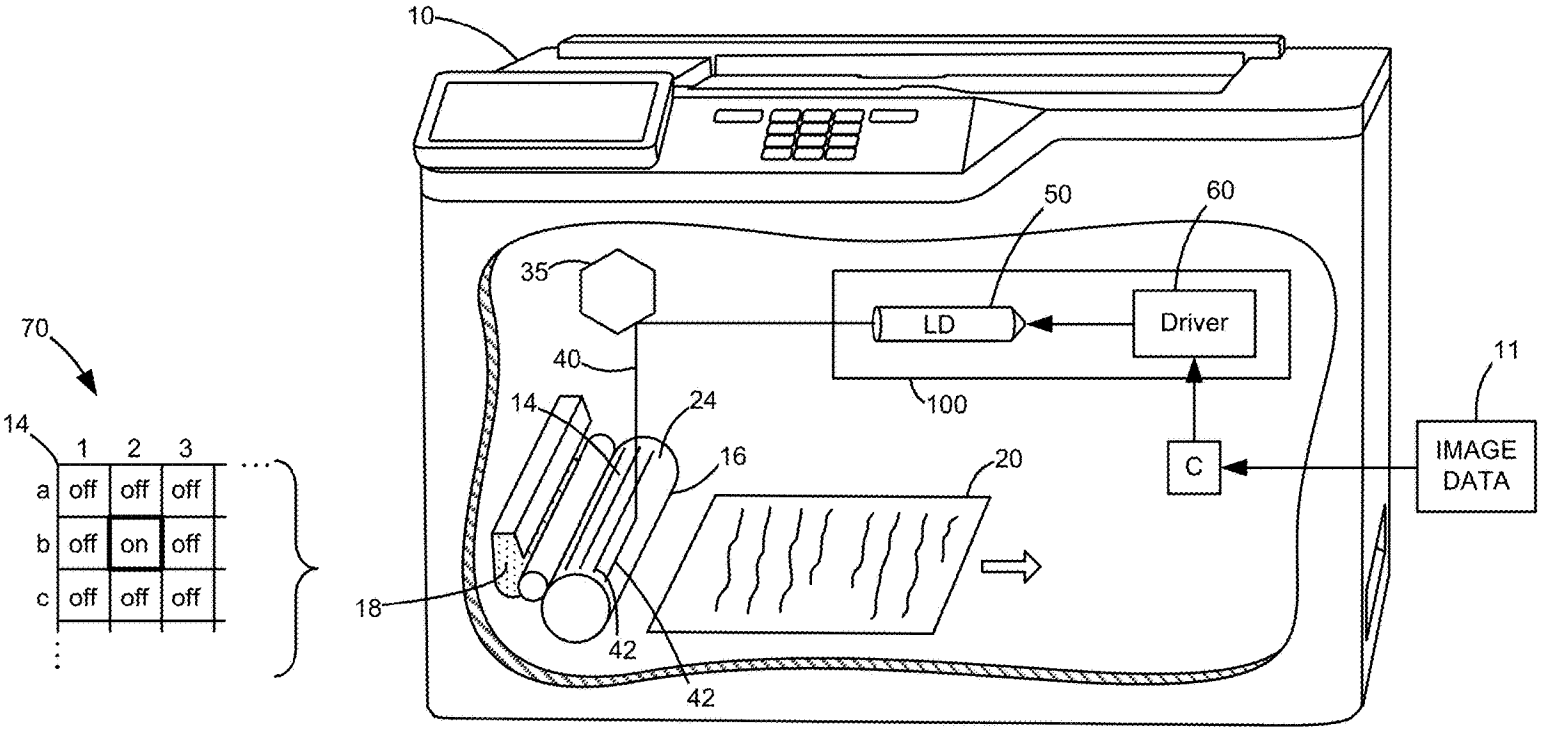
FIG. 1 is a diagrammatic view of an imaging device including cutaway with light source and driver for imaging a photoconductor.

With reference to FIG. 1, an imaging device 10 includes a controller (C) that receives imaging data 11 for printing on a media 20, as is familiar. The controller converts the imaging data in such a way that a latent electrostatic image 14 is formed on a photoconductor 16 for attracting toner 18 for transfer to the media 20. A surface 24 of the photoconductor is charged to an initial uniform voltage by a roller, corona, or the like (not shown). A rotating mirror 35 (or oscillating reflector) sweeps in scan paths 42 at least one laser beam 40 across the surface of the photoconductor to discharge pixels of imaging data to attract toner. A laser diode (LD) 50 creates the source of light for the laser beam upon receipt of suitable signals from a driver 60. The driver 60 is represented by a class of drivers of the type suitable for imaging device operations, such as Maxim Integrated, Inc.'s, Max3727, Max3727A, Max3728A and Max3728B. As instances of imaging pixels on the photoconductor contemplate pixels isolated from other pixels on a same or adjacent scan path, embodiments of the invention further contemplate a laser diode drive circuit 100 to enhance quality. An example of an isolated pixel is given as pixel b2 having no other adjacent pixels turned "on" in a same or adjacent scan path (a, b, c . . . ) in an imaging data map 70, for instance.

Figure 2:
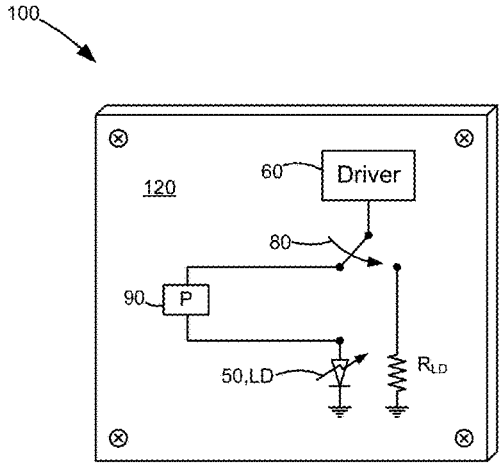
FIG. 2 is a diagrammatic view of a circuit board and circuit for driving the light source of the imaging device of FIG. 1.

With reference to FIG. 2, the laser diode circuit 100 includes the driver 60 and a switch 80 for gating on and off the laser diode 50, thus the light beam, according to on and off pixels of the imaging data. A resistor $R_{LD}$ complements the laser diode and is selectively connectable to the switch 80 whenever the switch is not connected to the laser diode 50. The resistor has an impedance as does the laser diode. The impedance of the resistor $R_{LD}$ can substantially approximate the impedance of the laser diode, but is more likely substantially greater than the impedance of the laser diode. In values, the impedance of the resistor $R_{LD}$ ranges from about 8 ohms to about 80 ohms. That the impedance of the laser diode is nearer the smaller end of the range of impedance of the resistor $R_{LD}$, nearer 8 ohms, the impedance of the resistor $R_{LD}$ ranges to as much as ten times the impedance of the laser diode, or more.

Figure 3A:
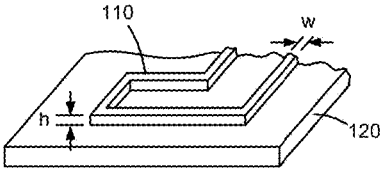
FIGS. 3A and 3B are partial diagrammatic views of the circuit board of FIG. 2, including conductive tracing.
Figure 3B:
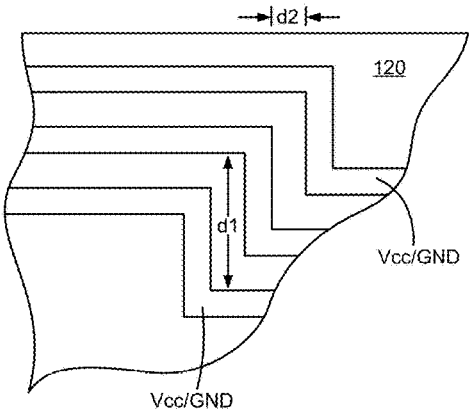
Figure 9A:
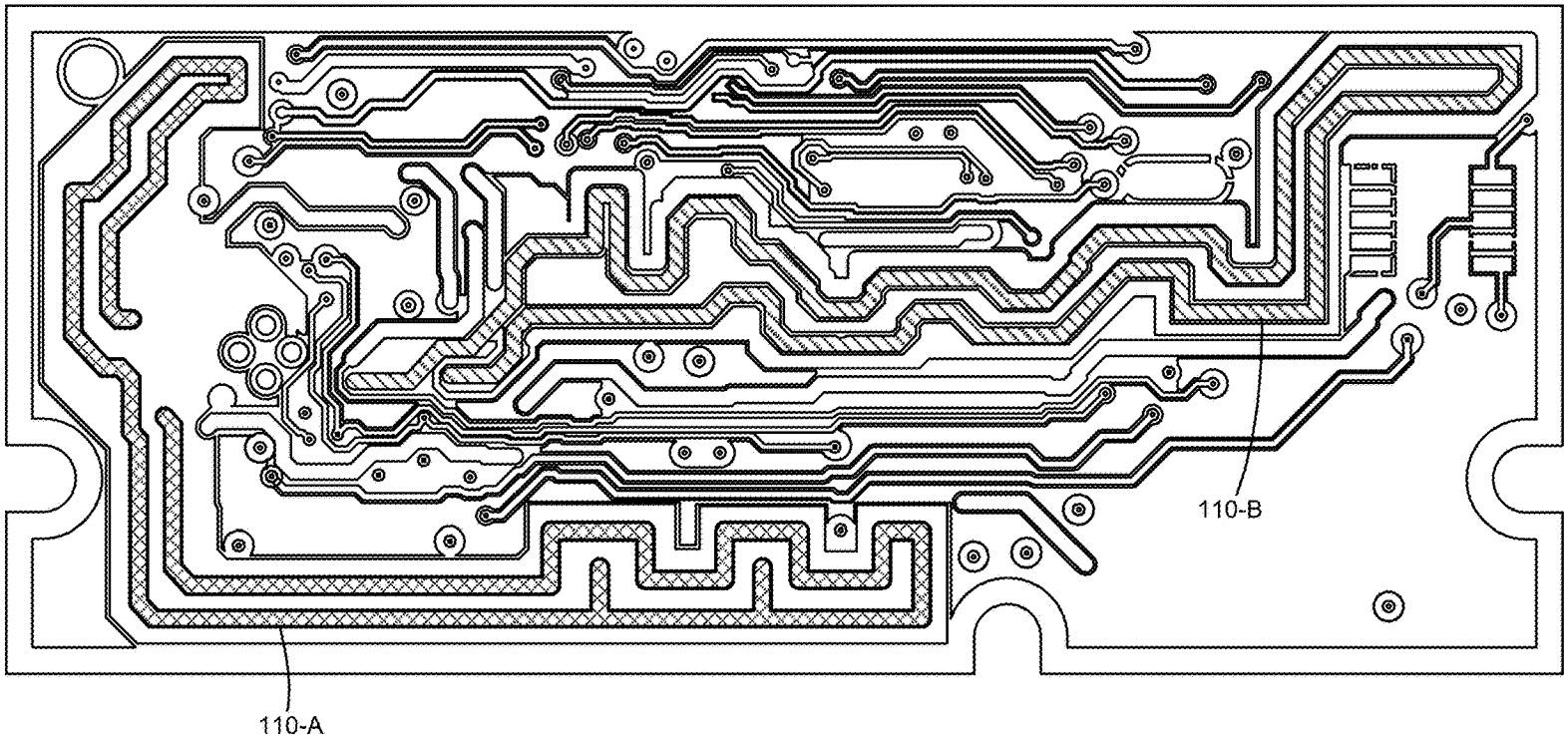
FIGS. 9A and 9B are diagrams of printed circuit boards having lengths of tracing.
Figure 9B:
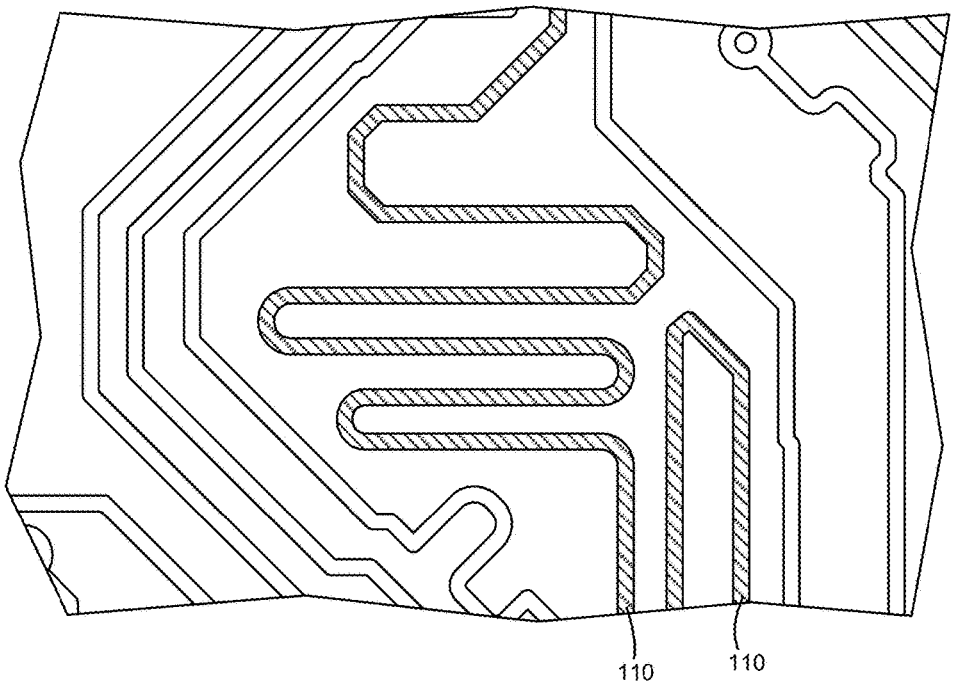

Connected to the laser diode is a passive circuit component (P) 90. The component P is any of a variety, but a delay line, inductor, choke, coiled wire, or ferrite bead is contemplated. The component may also typify a length of tracing on a printed circuit board (PCB) that supports the laser diode. As seen in FIG. 3A, a length of copper tracing 110 resides on a circuit board 120. The trace has a thickness or height, h, and a width, w, that varies according to an amount of current that is to be carried through the trace. In one design, the width is about 15 mils while the height is about 1.5-2 mils. The length of the trace also varies, but is typically longer than two inches and may extend for about 5 to about 8 inches or more. Also, if the PCB is a two-layer design, the trace is expected to keep proper relative distance spacing d1, d2, for example, between its neighboring Vcc/Ground lines as noted in FIG. 3B. In four-layer PCB designs, however, tracing resides on layers separate from either the Vcc or ground so the constraint of spacing is alleviated. Four-layer designs provide about 4-5 mils distance between the trace and the Vcc or Ground reference planes. In either the two- or four-layer PCBs, representative shapes of the trace 110 can be seen in FIGS. 9A (two-layer PCB) and 9B (four-layer PCB) as a meandering length of conductor that fits in available space on an appropriate layer of the PCB. FIG. 9A also notes the existence of multiple laser diodes, hence, multiple lengths of tracing 110-A and 110-B for each.

Figure 10:
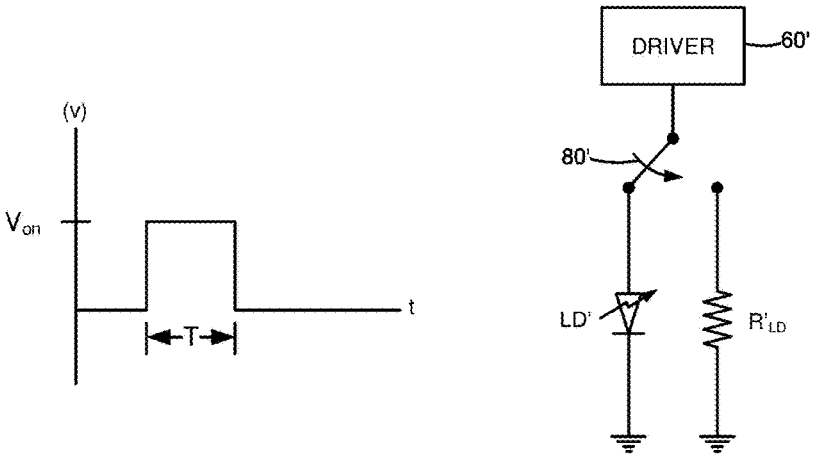
FIG. 10 (Prior Art)
FIG. 10 is a diagrammatic view of a circuit for driving a laser diode of the prior art.

With reference to FIG. 10, a prior art circuit to drive a laser diode 50' includes a laser driver 60' and switch 80' for gating on and off the laser diode according to imaging data. A resistor $R'_{LD}$ has an impedance comparable to that of the laser diode, thus balancing out the load on the switch regardless of position of the switch. The circuit is comparable to that of FIG. 2, but without the passive circuit component (P) 90. A typical voltage pulse to drive on and off the laser diode 50' has a voltage $V_{ON}$ that lasts for an on-time of T. It defines a traditional square wave.

Figure 4:
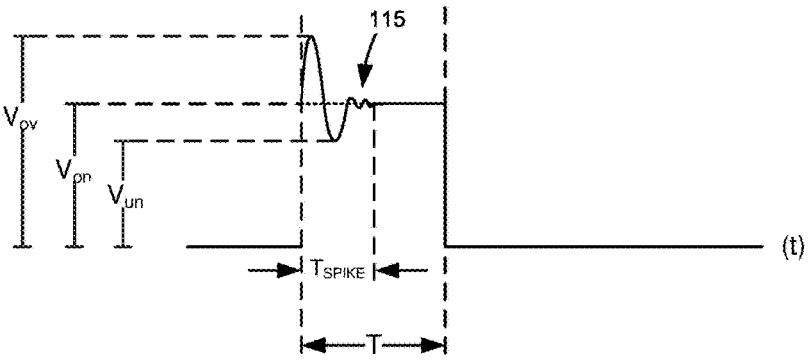
FIG. 4 is a voltage diagram for driving the light source.

With the laser diode drive circuit 100 of the present invention, in contrast, the passive circuit component and selection of the values of resistor $R_{LD}$ yields a voltage pulse that creates a large incident wave of current to the laser diode to augment its optical power during initial turn on. In this way, the photoconductor for isolated pixels will discharge to a greater degree compared to the prior art, thereby improving toner adhesion, thereby improving image quality. With reference to FIG. 4, the voltage pulse of the present embodiment includes a pulse that has initial "ringing" but then dampens into a traditional square wave with on-voltage $V_{ON}$. The pulse includes an initial overshoot voltage spike Vov and then undershoot voltage $V_{UN}$ and further, smaller voltage oscillations 115. The initial overshoot voltage spike ranges about 20% or more than the $V_{ON}$ in the circuit absent the passive circuit component (FIG. 10). The undershoot of the voltage $V_{UN}$ relative to $V_{ON}$ is not as great as the overshoot of the voltage Vov relative to $V_{ON}$ as are successive voltage oscillations 115 smaller than earlier voltages before a stabilizing voltage is reached. A typical $V_{ON}$ ranges about 1-2.5 volts, but can vary depending upon application. In time, the dampening of the voltage spike occurs in $T_{SPIKE}$ that approximates one-fourth or less of the total voltage on time T of but a single traditional pulse. When conducting imaging operations in an imaging device at 1200 dpi, for example, a traditional on-time (T) lasts about eight to nine (8-9) nsec for gating on the laser diode. The dampening then ($T_{SPIKE}$) exists on the order at about two to about three (2-3) nsec. Of course, if the signal were to remain active for more than one pulse, the time for dampening would still occur in about two to about three (2-3) nsec.

Figure 7:
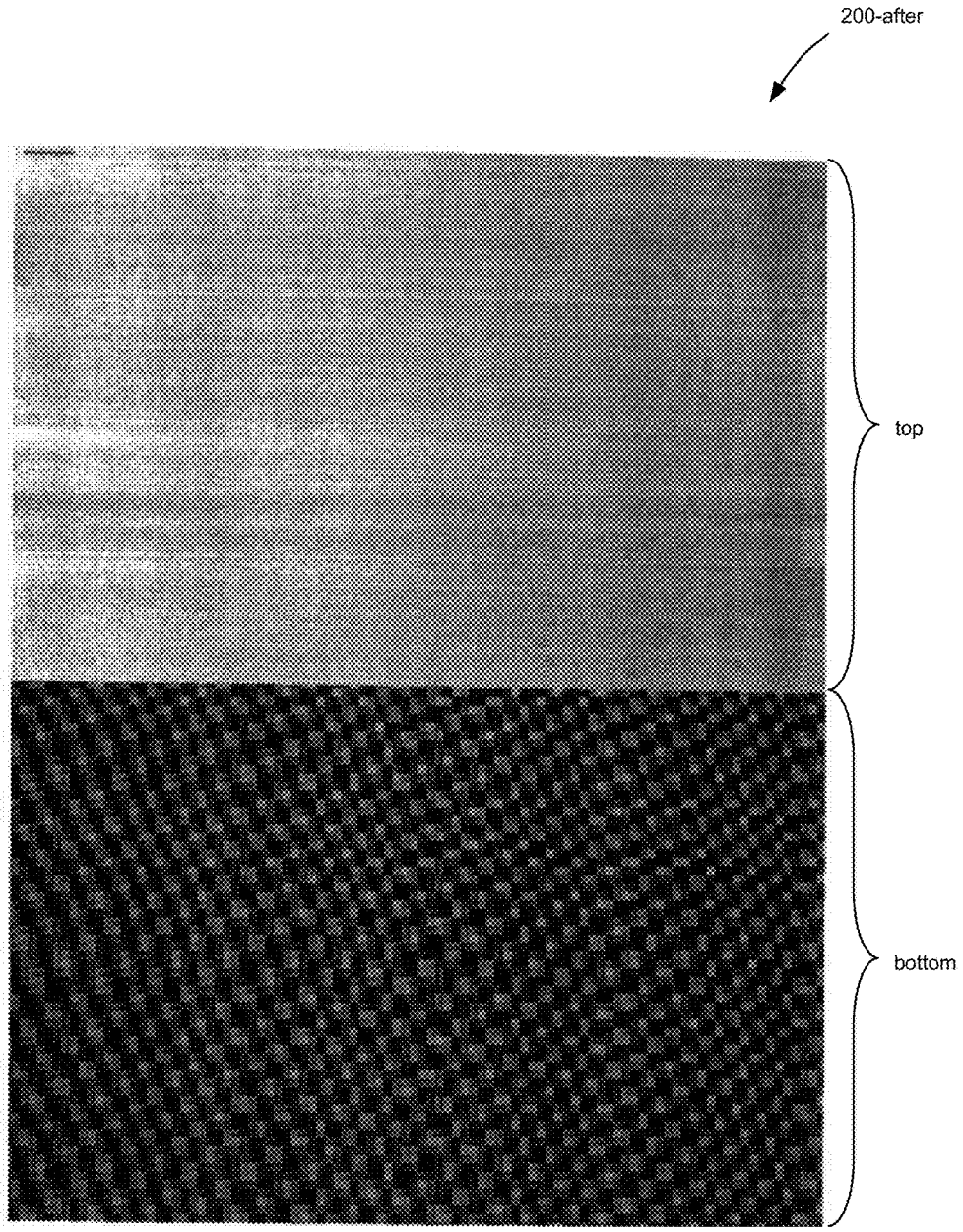
FIGS. 7 and 8 are comparative imaging results for the circuit according to the invention.
Figure 8:
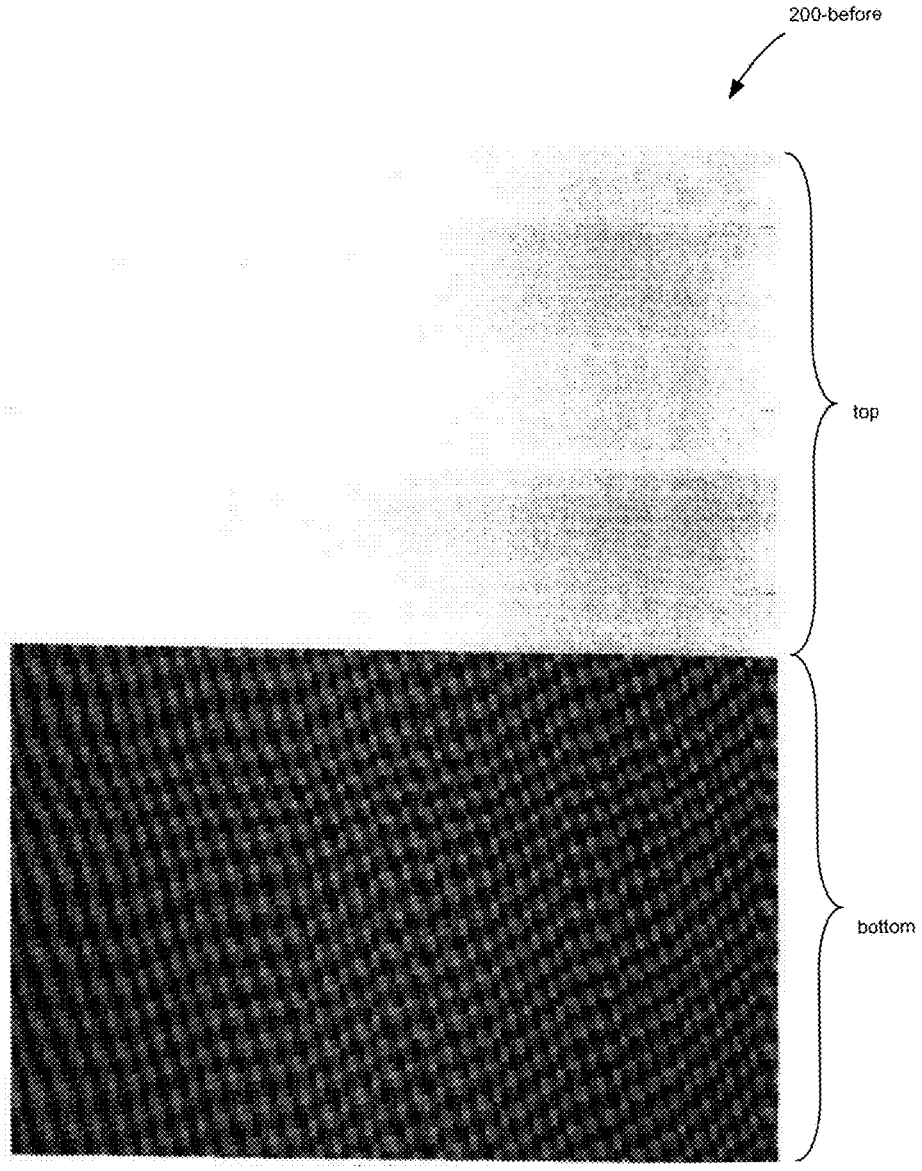

With reference to FIGS. 7 and 8, comparable images are provided for images generated on media with the laser diode drive circuit of the invention having the passive component P, 200—after, and a circuit not having the passive circuit component, 200—before. In the top half of each image 200, isolated pixels are imaged. In the 200—after image, there is much darker print for the extra toner that adheres to the media than the 200—before image, thereby enhancing image quality. In the bottom half of each image 200, little change is observed for the half-toned pixels. The result is improved imaging of isolated pixels without adversely affecting gray-scale imaging.

Figure 5:
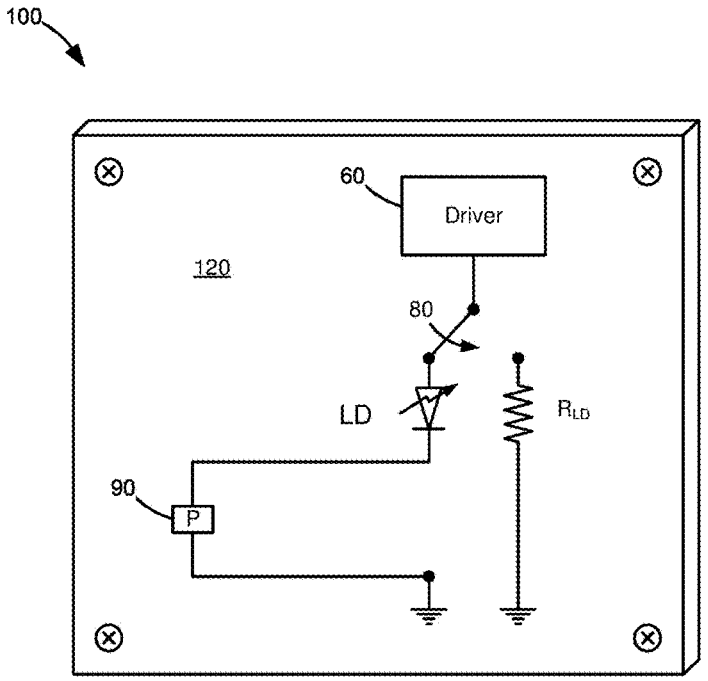
FIG. 5 is a diagrammatic view of a circuit board and alternate circuit for driving the light source of the imaging device of FIG. 1.
Figure 6:
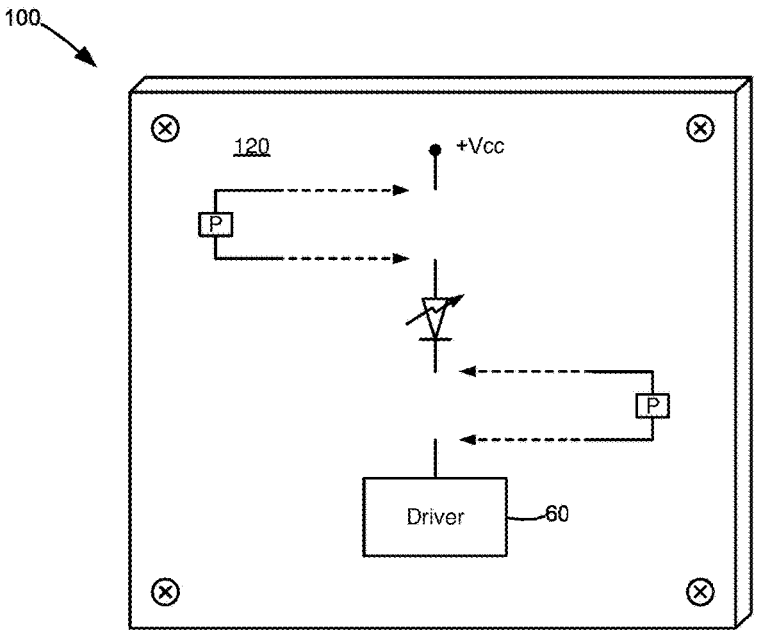
FIG. 6 is an alternative design of the circuit for driving the light source.

In alternate embodiments, it is noted that the passive circuit component P can reside on either side of the laser diode and still effect the same benefit as in FIG. 7. With reference to FIG. 5, the passive circuit component (P) 90 connects between the laser diode and ground, unlike FIG. 2 where it connects between the switch and the laser diode. In FIG. 6, the laser diode LD connects to the driver 60 as a common cathode configuration, not as a common anode configuration. In this way, the passive circuit component (P) either resides between the laser diode and Vcc or between the laser diode and the driver 60 as noted by the dashed lines. Also, the switch can reside as part of the driver 60 or externally to it. Other embodiments are possible.

The foregoing illustrates various aspects of the invention. It is not intended to be exhaustive. Rather, it is chosen to provide the best mode of the principles of operation and practical application known to the inventors so one skilled in the art can practice it without undue experimentation. All modifications and variations are contemplated within the scope of the invention as determined by the appended claims. Relatively apparent modifications include combining one or more features of one embodiment with those of another embodiment.

The invention claimed is:

1. An imaging device, comprising:

a laser diode;

a photoconductor having a surface that is selectively discharged by a light from the laser diode to create a latent electrostatic image for attracting toner for transfer to a media; and a laser diode drive circuit, the circuit including a switch for gating on and off the light from the laser diode, a resistor complementary to the laser diode selectively connectable to the switch, and a passive circuit component coupled to the laser diode, wherein the laser diode drive circuit creates a voltage pulse for turning on the light of the laser diode, the passive circuit component causing the voltage pulse to have an initial overshoot voltage spike about 20% or more than an on voltage of a voltage pulse in the circuit absent the passive circuit component.

2. The imaging device of claim 1, wherein the passive circuit component is a delay line, inductor, choke, coiled wire, or ferrite bead.

3. The imaging device of claim 1, wherein the passive circuit component is a length of copper tracing on a printed circuit board supporting the laser diode drive circuit.

4. The imaging device of claim 3, wherein the length of copper tracing extends in a range of about two inches to about 8 inches.

5. The imaging device of claim 1, wherein the laser diode drive circuit further includes a laser driver connected on either an anode or cathode side of the laser diode.

6. The imaging device of claim 1, wherein the laser diode has an impedance and the resistor has a resistance value in ohms that is substantially equivalent to the impedance.

7. The imaging device of claim 1, wherein the laser diode has an impedance and the resistor has a resistance value in ohms that is substantially larger than the impedance.

8. The imaging device of claim 1, wherein the resistor ranges in value from about 8 to about 80 ohms.

9. The imaging device of claim 1, wherein the passive circuit component electrically connects between the switch and the laser diode.

10. The imaging device of claim 1, wherein the passive circuit component electrically connects between the laser diode and ground.

11. The imaging device of claim 1, wherein the passive circuit component causes the initial overshoot voltage spike to dampen out in about one-fourth of a total voltage on time of the voltage pulse.

12. A laser diode circuit for driving a laser diode in an imaging device to selectively discharge a photoconductor to create a latent image, the circuit comprising:

a substrate for supporting the circuit;

a switch for turning on and off a light from the laser diode;

a resistor complementary to the laser diode selectively connectable to the switch; and a length of conductive tracing on the substrate coupled to an anode or cathode of the laser diode, wherein upon the switch turning on the light from the laser diode, the conductive tracing causing an initial overshoot voltage spike to the laser diode that dampens out to a stabilizing on-voltage before the switch turns off the light from the laser diode.

13. The laser diode circuit of claim 12, wherein the length of conductive tracing extends in a range of about two to about 8 inches.

14. The laser diode circuit of claim 12, wherein the length of conductive tracing electrically connects between the switch and the laser diode.

15. The laser diode circuit of claim 12, wherein the length of conductive tracing electrically connects between the laser diode and ground.

16. The laser diode circuit of claim 12, wherein the laser diode has an impedance and the resistor has a resistance value that is substantially larger than the impedance.

17. The laser diode circuit of claim 12, wherein the resistor ranges in value from about 8 to about 80 ohms.

18. A method of creating a pulse to turn on a laser diode in an imaging device to selectively discharge a photoconductor to create a latent image, comprising:

creating an initial overshoot voltage spike in a circuit with a passive circuit component that is about 20% or more than an on voltage of a voltage pulse in the circuit absent the passive circuit component; and dampening out the initial overshoot voltage spike in about one-fourth of a total voltage on time of the pulse.

19. The method of claim 18, wherein the total voltage on time of the pulse is about 8 to about 9 nanoseconds, further including dampening out the initial overshoot voltage spike in about 2 to about 3 nanoseconds.

20. The method of claim 18, further including connecting the passive circuit component to the laser diode on either an anode or cathode side of the laser diode.

* * * * *